United States Patent [19]

Allison

[11] Patent Number: 4,730,731

[45] Date of Patent: Mar. 15, 1988

[54] CHILD-RESISTANT CONTAINER

[75] Inventor: Blaine Allison, Pemberville, Ohio

[73] Assignee: Lumelite Corporation, Pawling, N.Y.

[21] Appl. No.: 926,556

[22] Filed: Nov. 4, 1986

[51] Int. Cl.[4] ..... B65D 83/04

[52] U.S. Cl. ..... 206/540; 206/1.5; 206/37; 220/337; 292/87

[58] Field of Search ..... 206/1.5, 37, 38, 540, 206/581, 807; 292/87, 121, 128, 175; 220/DIG. 26, 323, 315, 337, 339; 229/45 R

[56] References Cited

U.S. PATENT DOCUMENTS

| | | | |
|---|---|---|---|
| 2,195,593 | 4/1940 | Kreisler | 220/DIG. 26 |
| 2,358,607 | 9/1944 | Tinnerman | 292/87 |
| 2,655,259 | 10/1953 | Davoren | 206/38 |
| 3,285,464 | 11/1966 | Boydman | 220/337 |
| 3,749,230 | 7/1973 | Foster . | |
| 3,894,655 | 7/1975 | Mattheis et al. . | |
| 3,913,774 | 10/1975 | Vajtay | 220/315 |
| 3,923,180 | 12/1975 | Fields | 220/337 |
| 3,954,179 | 5/1976 | Warmath | 206/528 |
| 3,968,880 | 7/1976 | Ostrowsky . | |
| 3,972,416 | 8/1976 | Underwood . | |
| 4,007,828 | 2/1977 | Mayled . | |
| 4,102,452 | 7/1978 | Sato et al. | 220/337 |
| 4,174,043 | 11/1979 | Hoo . | |
| 4,363,403 | 12/1982 | Raucci, Jr. et al. | 206/1.5 |
| 4,365,711 | 12/1982 | Long et al. | 220/337 |
| 4,511,032 | 4/1985 | Bush . | |
| 4,561,544 | 12/1985 | Reeve . | |

*Primary Examiner*—David T. Fidei

*Attorney, Agent, or Firm*—Laubscher & Laubscher

[57] ABSTRACT

A unitary child-resistant container for pills and the like includes a rectangular tray-shaped body member to which a top closure member is connected by an integral hinge. The top closure member includes a front wall that is normally latched to the front wall of the body member by a latch device that is released by a release button that extends outwardly from the deformable front wall of the body member through a corresponding opening contained in the closure member front wall. Consequently, opening of the container requires the simultaneous depression of the release button and the application of a vertical lifting force on the top closure member. Stiffening ribs may be provided on the underside of the top closure member for frictional engagement with the inner surfaces of the body member side walls, thereby to further retain the closure member in the closed position. Preferably, the container is molded in one step from synthetic plastic material.

4 Claims, 7 Drawing Figures

FIG. 1
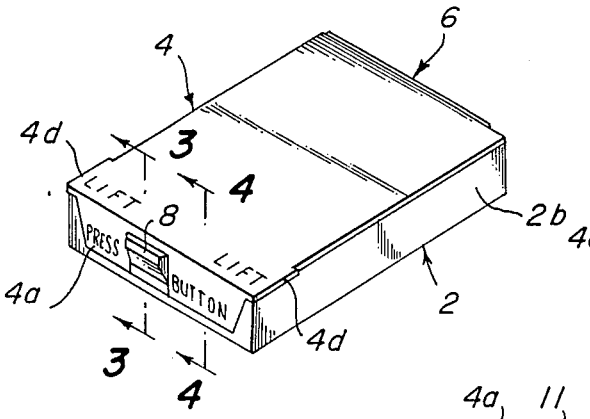
FIG. 2
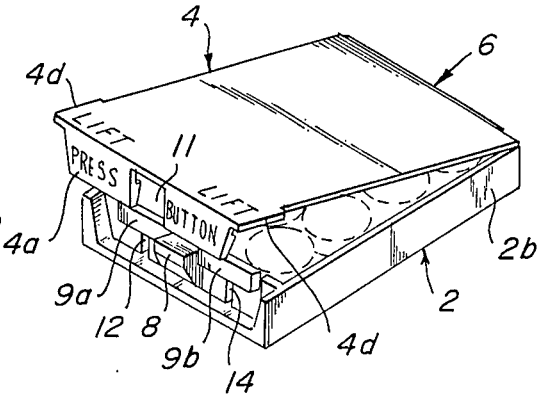
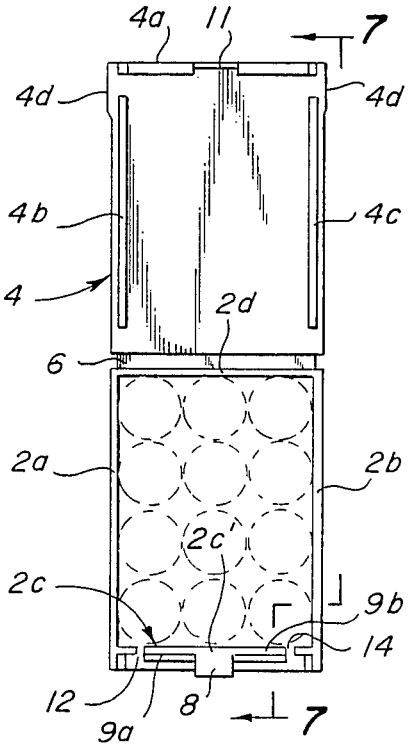
FIG. 6
FIG. 7
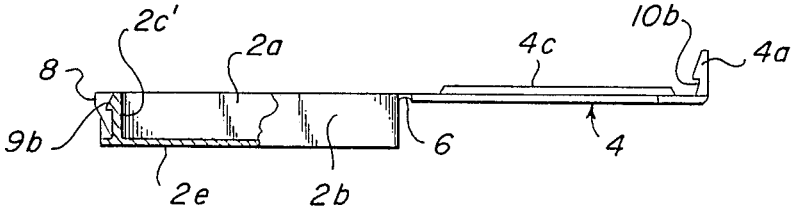

CHILD-RESISTANT CONTAINER

BRIEF DESCRIPTION OF THE PRIOR ART

This invention relates to an improved child-proof container of unitary molded synthetic plastic construction including closure latching means preventing unauthorized opening by a child, but which are readily operable by an adult.

Child-proof containers for medicinal pills, tablets, capsules and the like are well known in the art, as evidenced, for example, by the prior patents to Foster U.S. Pat. No. 3,749,230, Ostrowsky U.S. Pat. No. 3,968,880 and Reeve U.S. Pat. No. 4,561,544. One drawback of the prior child-resistant containers is that the means which prevent opening by a child often make the container difficult to open by an adult. Moreover, the prior containers are relatively expensive to manufacture, particularly when complex latching means are provided for maintaining the container in a closed condition.

The present invention was developed to avoid the above and other drawbacks of the known child-resistant containers.

SUMMARY OF THE INVENTION

A primary object of the present invention is to provide a unitary child-proof container including a tray-shaped body member, a top closure member connected with the body member by integral hinge means, and latch means for releasably fastening the top closure member in the closed position. The unitary container is preferably formed by molding from a suitable synthetic plastic materal, such as polypropylene.

According to a more specific object of the invention, the top closure member includes a front wall that extends downwardly in face-to-face relation with the outer surface of the corresponding front wall of the body member, the latching means including at least one horizontal projection extending from one of the front walls for normal reception within a corresponding recess contained in the other wall. A release button connected with the resilient container front wall extends horizontally forwardly through, and outwardly beyond, a corresponding opening contained in the closure front wall, whereby to open the container, the release button is inserted to displace the container front wall to unlock the latch means, thereby permitting pivotal opening of the closure member.

According to a further object of the invention, the top closure member is provided on its bottom surface with a plurality of stiffening ribs that frictionally engage the inner surfaces of the side walls of the body member when the closure member is in the closed condition, thereby affording means for frictionally resisting opening of the container. To assist in overcoming this frictional resistance, the top closure member is provided at its forward end with a pair of lifting tabs that extend laterally outwardly beyond the side walls of the body member.

BRIEF DESCRIPTION OF THE DRAWINGS

Other objects and advantages of the invention will become apparent from a study of the following specification when viewed in the light of the accompanying drawings, in which:

FIGS. 1 and 2 are perspective views of the container of the present invention in the closed and partially open conditions, respectively;

FIG. 6 is a top plan view of the container in the fully open condition; and

FIG. 7 is a partially sectioned side elevational view taken along line 7—7 of FIG. 6.

DETAILED DESCRIPTION

Referring first more particularly to FIGS. 1 and 2, the child-resistant container is of unitary construction formed by injection molding from a suitable synthetic plastic material, such as polypropylene, and includes a tray-shaped body member 2, a rectangular generally planar top closure member 4, and integral hinge means 6 connecting the top member for pivotal movement between closed (FIG. 1), partially open (FIG. 2) and fully open (FIGS. 6 and 7) positions relative to the body member. Releasable latch means operable by a release button 8 are provided for normally locking the top closure member in the closed position of FIG. 1.

The body member 2 includes a pair of side walls **2*a* and 2*b*, front and rear end walls 2*c* and 2*d*, respectively, and a bottom wall 2*e*. The top closure member 4 is of a generally planar rectangular configuration having a rear edge portion connected with the upper edge of the rear end wall 2*d* of the body member by the integral hinge means 6. At its forward end, the top closure member includes a downwardly extending front wall portion 4*a* that extends in face-to-face relation adjacent the outer surface of the body member front wall 2*c* when the top member is in the closed latched condition of FIGS. 1 and 4**.

Figure 3:
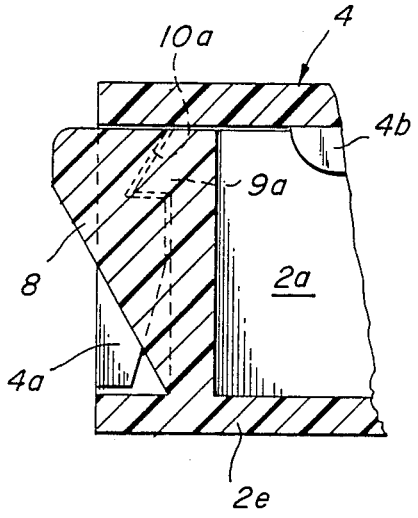
FIGS. 3 and 4 are detailed sectional views along lines 3—3 and 4—4, respectively, of FIG. 1.
Figure 5:
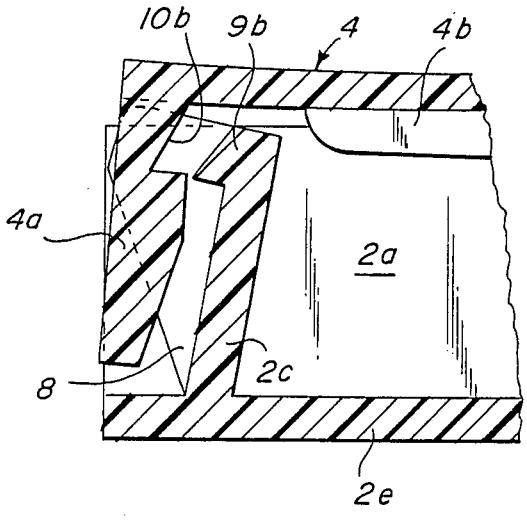
FIG. 5 is a detailed sectional view illustrating the latching means of FIG. 4 in the fully released condition.
Figure 4:
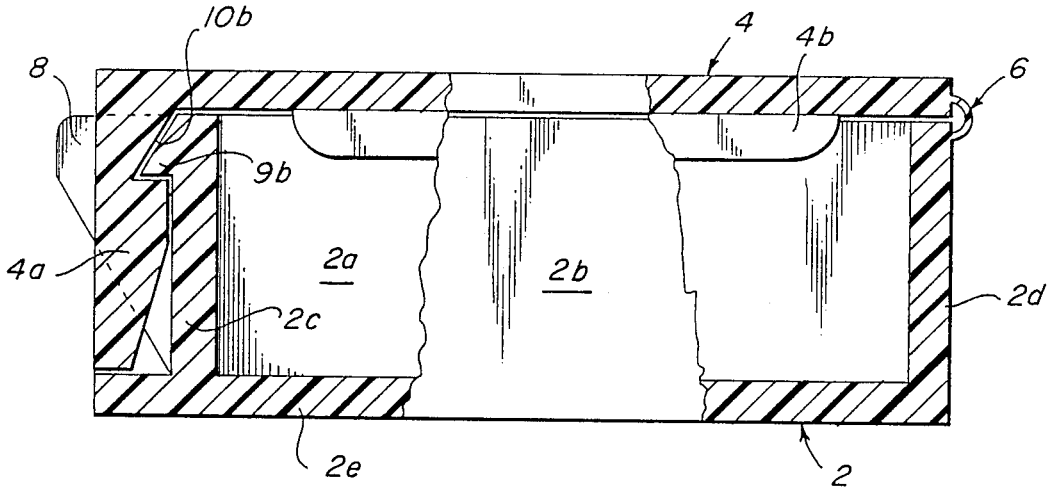

The top closure member 4 is provided on its lower surface with a pair of stiffening ribs **4*b* and 4*c* that extend parallel to, and in frictional contact with, the inner surfaces of the body member side walls 2*a* and 2*b*, respectively, when the top member 4 is in both the closed latched condition of FIG. 4, and the unlatched partially open condition of FIG. 5. The top closure member 4 is provided at its forward end with a pair of laterally extending lifting tabs 4*d*** that extend beyond the body member side walls to provide lifting means for pivoting the unlatched top member to the open position.

The releasable latch means are operable by a release button 8 integrally formed with, and extending horizontally forwardly from, the body front wall **2*c* via an opening 11 contained in closure member front wall 4. A pair of horizontal latch projections 9*a* and 9*b* are integrally formed with front wall 2*c* for normal insertion within corresponding recesses 10*a* and 10*b*, respectively, contained in the closure member front wall 4*a*, as shown in FIG. 4. According to an important feature of the present invention, body front wall 2*c* contains on opposite sides of the latch release button a pair of downwardly extending slots 12 and 14, as shown in FIG. 6, that define in the body front wall 2*c* a deformable center portion 2*c*′ carrying the release button 8*a***.

To open the closed, normally latched container, the user with one hand merely merely inserts release button 8 to the fully-released portion of FIG. 5 to deform front wall portion **2*c*′ of the resilient front wall to release projections 9*a* and 9*b* from their corresponding recesses 10*a* and 10*b*, respectively, and with the other hand the user lifts up on tabs 4***d* to pivot the top closure member upwardly against the frictional resistance provided between the ribs on the closure member and the side walls of the body member. Upon return of the closure member 4 to its closed position, the latch means is automatically locked by the insertion of projections 9*a* and 9*b* into the corresponding recesses.

What is claimed is:

1. A unitary child-resistant container for pills or the like, comprising:

(a) a rectangular tray-shaped body member having bottom, side, front and rear end walls;

(b) a generally rectangular top closure member operable, when in a closed position, to overlie said body member to define a closed chamber;

(c) integral hinge means pivotally connecting the upper edge of said body rear wall with the adjacent edge of said top closure member, thereby to afford pivotal movement of said top closure member from said closed position to an open position relative to said body member, said top closure member, when in the closed position, including a downwardly extending front wall arranged in face-to-face relation opposite the outer surface of said body front wall;

(d) latch means for releasably fastening said top closure member to said body member when said closure member is in the closed position, said latching means including at least one horizontal latching projection normally extending from one of said front walls of said top closure and body members for insertion within a corresponding recess contained in the other of said members, respectively;

(e) latch release means including a release button connected with the outer surface of said body member front wall and extending horizontally forwardly therefrom through, and outwardly beyond, an opening contained in said closure member front wall, said body front wall being resiliently deformable upon depression of said button release said latching projection from said recess; and (f) opening resisting means for resisting opening of said top closure member from said body member when said latching projection is release from said recess, including a pair of stiffening ribs arranged on the lower surface of said top closure member when said top closure member is in the closed condition for frictional engagement with the adjacent surfaces of the side walls of said body member, respectively, thereby to frictionally resist pivotal movement of said closure member in the direction from the closed position toward the open position;

(g) said body member front wall containing a pair of horizontally spaced vertical slots (12,14) extending downwardly from the upper edge thereof, thereby to define a deformable front end wall portion (2*c*′) carrying both said latch release means and one of said latching means, whereby said deformable portion is operable independently of said side walls and said opening resisting means.

2. Apparatus as defined in claim 1, wherein said top closure member contains a pair of laterally extending lifting tabs adjacent said front wall, said lifting tabs extending laterally outwardly beyond said body member side walls when said top member is in the closed position, thereby to afford means for lifting said top closure member from the unlatched closed position.

3. Apparatus as defined in claim 2, wherein said unitary container is formed by molding in one step from resilient plastic material.

4. Apparatus as defined in claim 1, wherein said latching means includes a horizontally-spaced pair of said projections carried by said deformable body member front end wall portion, said release button extending between said latching projections.

* * * * *